United States Patent [19]

Kabasin

[11] Patent Number: 4,881,502

[45] Date of Patent: Nov. 21, 1989

[54] PEDAL FORCE RESPONSIVE ENGINE CONTROLLER

[75] Inventor: Daniel F. Kabasin, Rochester, N.Y.

[73] Assignee: General Motors Corporation, Detroit, Mich.

[21] Appl. No.: 235,674

[22] Filed: Aug. 24, 1988

[51] Int. Cl.[4] ..... F02D 11/10; F02D 41/22

[52] U.S. Cl. ..... 123/399; 123/479

[58] Field of Search ..... 123/339, 361, 395, 399, 123/403, 479

[56] References Cited

U.S. PATENT DOCUMENTS

| | | | |
|---|---|---|---|
| 4,393,833 | 7/1983 | Mann et al. | 123/399 X |
| 4,445,603 | 5/1984 | Filsinger | 192/0.055 |
| 4,488,527 | 12/1984 | Pfalzgraf et al. | 123/399 |
| 4,491,112 | 1/1985 | Kanegae et al. | 123/399 X |
| 4,519,360 | 5/1985 | Murakami | 123/399 |
| 4,519,361 | 5/1985 | Murakami | 123/399 |
| 4,640,248 | 2/1987 | Stoltman | 123/399 |
| 4,819,597 | 4/1989 | Gale et al. | 123/399 |

*Primary Examiner*—Willis R. Wolfe

*Attorney, Agent, or Firm*—Howard N. Conkey

[57] ABSTRACT

An engine control system monitors the force applied to the accelerator pedal and normal engine operating conditions during which the force applied to the pedal is normally zero and provides for normal engine operation if these conditions exist. When the force applied to the accelerator pedal is zero and none of the normal engine operating conditions at which the force applied to the accelerator pedal is normally zero exist, the engine is forced into a back-up control mode.

3 Claims, 3 Drawing Sheets

PEDAL FORCE RESPONSIVE ENGINE CONTROLLER

This invention relates to an accelerator pedal force responsive engine controller and, more particularly, to a controller responsive to an applied force to the vehicle accelerator pedal and to predetermine engine operating conditions to establish the engine control either in a normal operating mode or in a back-up operating mode.

Engine controllers responsive to engine operating conditions for enabling back-up control are known. One such system includes a drive by wire controller that monitors the force applied to the accelerator pedal and forces an engine idle mode if the applied force is zero. This form of system is illustrated in the U.S. Pat. No. Stoltman 4,640,248 assigned to the assignee of this invention.

This invention recognizes that there are valid engine operating modes in which the force applied to the accelerator pedal is zero. Accordingly, it would not be desirable to establish a back-up operating mode in response to these operating conditions. For example, when a vehicle is being operated in a cruise control mode to maintain the vehicle speed at a selected value, the force on the accelerator pedal is zero. Similarly, when the engine is operating in a closed loop idle speed control mode, the force applied to the accelerator pedal is zero. In each case, it would not be desirable to establish back-up control for the engine operation.

This invention monitors the force applied to the accelerator pedal and normal engine operating conditions during which the force applied to the pedal is normally zero and provides for normal engine operation if these conditions exist. However, when the force applied to the accelerator pedal is zero and none of the normal engine operating conditions at which the force applied to the accelerator pedal is normally zero exist, the engine is forced into a back-up control mode to provide for fail-safe engine operation.

The invention may be best understood by reference to the following description of a preferred embodiment of the invention and the drawings in which.

Figure 2:
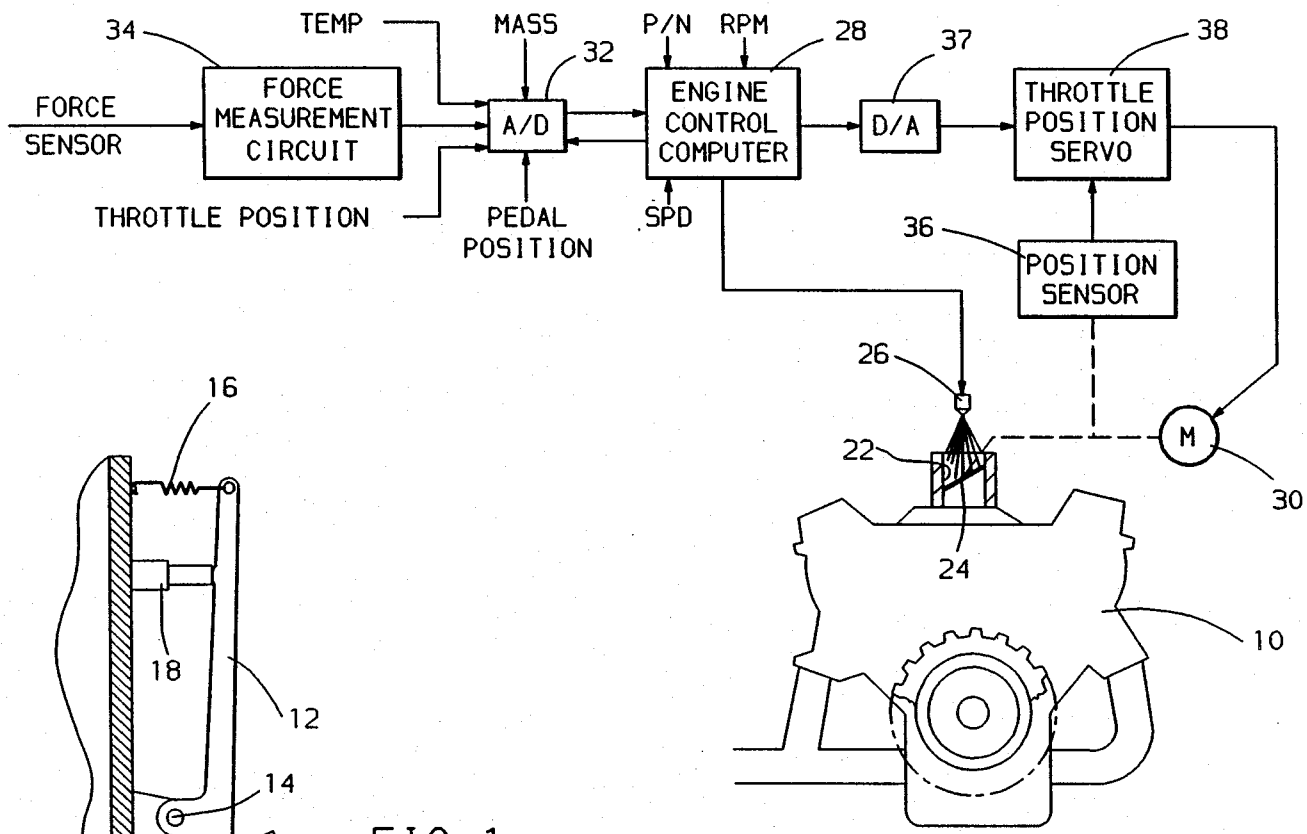
FIG. 2 is a diagram of the vehicle engine and controller incorporating the principles of this invention.
Figure 1:
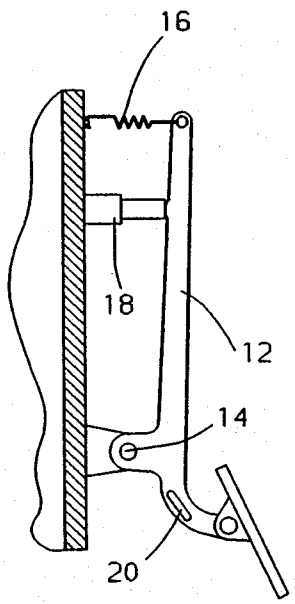
FIG. 1 is a schematic diagram of a vehicle accelerator pedal in a vehicle drive by wire system incorporating the principles of this invention.

Referring to FIGS. 1 and 2, an internal combustion engine 10 is controlled by a vehicle operator by application of force to an accelerator pedal 12 tending to rotate the pedal 12 about a pivot 14 to an off idle position in opposition to a return force exerted by a spring 16 tending to rotate the pedal 12 to an engine idle position. The pedal 12 rotates from its engine idle position to an off idle position that is dependent upon the magnitude of the vehicle operator applied force opposing the force of the spring 16.

The position of the pedal 12 is used by an engine controller illustrated in FIG. 2 to adjust the cylinder charge of the engine 10. In this embodiment, the position of the pedal 12 represents a desired fuel injection amount. In this case, the engine controller controls engine fuel injectors to inject the desired amount and then adjust the mass airflow into the engine to achieve a desired air/fuel ratio. In another embodiment, the position of the pedal 12 may represent a desired mass airflow amount. In this case, the engine controller adjusts the mass airflow into the engine to equal the desired flow and controls the quantity fuel injected into the engine 10 to achieve the desired air/fuel ratio.

To provide a measure of the position of the pedal 12 representing the operator input command, a linear potentiometer 18 is positioned so as to be actuated by rotation of the pedal 12 about the pivot 14. The output of the potentiometer 18 is utilized in the engine controller of FIG. 2 to control the air and fuel input to the engine 10. In addition, a force sensor 20, which may take the form of a resistive strain gauge, is carried by the pedal 12 so as to provide an output that is a measure of the force applied to the pedal 12 by the vehicle operator in opposition to the spring force on the pedal 12 by the spring 16.

Referring to FIG. 2, air and fuel are drawn into the engine 10 through a throttle bore 22 having a throttle blade 24 positioned therein to control the airflow into the engine 10. Fuel is injected into the throttle bore 22 at a position above the throttle blade 24 via a fuel injector 26. In this embodiment, the quantity of fuel injected by the fuel injector 26 is commanded by the accelerator pedal 12 and the throttle blade 24 is positioned to control the airflow into the engine to achieve a desired air/fuel ratio.

The control of the fuel injector 26 and the throttle blade 24 is accomplished by an engine controller, the primary element of which is an engine control computer 28 in the form of a standard digital microprocessor having a an operating program stored therein whose step-by-step execution controls the fuel injector 26 and positions the throttle blade 24 in accord with the principles of this invention.

In general, the computer 28 issues timed pulses to the fuel injector 26 to inject fuel into the engine 10 based on the position of the accelerator pedal 12 and controls the position of the throttle blade 24 via a servomotor 30 to achieve the airflow producing the desired air/fuel ratio. The computer 28 is a conventional automotive computer including memories, central processing unit, input/output circuits and a clock and may be programmed to achieve the functions set forth in the flow diagrams of FIGS. 3 and 4 by the normal exercise of skill in the art.

The measurements of various analog signals are provided to the computer 28 via an analog-to-digital circuit 32. These signals include the output of the linear potentiometer 18 representing the position of the pedal 12, the output of a conventional mass airflow sensor (not illustrated) measuring the mass airflow into the engine 10, the output of a force measurement circuit 34 representing the force sensed by the force sensor 20 and an engine coolant temperature signal provide by a conventional temperature sensor exposed to the engine coolant and an analog signal representing the position of the throttle blade 24 provided by a position sensor 36. The position sensor 36 may take the form of a potentiometer driven by the output shaft of the servomotor 30 and whose output is representative of the angular position of the throttle blade 24. The various analog signals are converted to digital signals by the analog-to-digital converter 32 upon command of the engine control computer 28. The digital values are stored in a random access memory in the computer 28 for use in controlling the fuel injector 26 and for controlling the position of the throttle blade 24.

The engine control computer 28 further receives a pulse input representing the engine RPM from a conventional ignition distributor and a pulse input representing vehicle speed from a conventional speed sensor provided in the vehicle transmission. The engine speed pulses are provided once each intake event and functions to initiate operation of the injector 26 which provides a pulse of fuel for each intake event of the engine 10. The RPM signal is further utilized to determine the speed of rotation of the engine 10. Similarly, the vehicle speed signal is utilized to determine vehicle speeds which is utilized when the controller is establishing a commanded vehicle speed during a cruise control operating mode of the system. A discrete input representing a neutral state (park and neutral gearshift positions) of the conventional vehicle automatic transmission is also provided to the engine control computer 28. This signal may be provided as is well known such as by a switch that is actuated when the transmission gear selector is in park or neutral.

The output of the engine control computer 28 is a timed pulse to the fuel injector 26 having a width calculated to provide the quantity of fuel commanded by the position of the accelerator pedal 12. Additionally, the computer 28 provides a digital signal to a digital-to-analog converter 37 representing a commanded throttle blade position determined to produce a desired mass airflow into the engine resulting in a desired air/fuel ratio. The output of the digital-to-analog converter 37 is provided to a throttle position servo 38. The servo 38 responds to the commanded throttle position provided via the digital-to-analog circuit 37 and the actual position of the throttle 24 provided by the sensor 36 to supply a signal to the servomotor 30 to position the throttle blade 24 to achieve the commanded throttle position.

Figure 3:
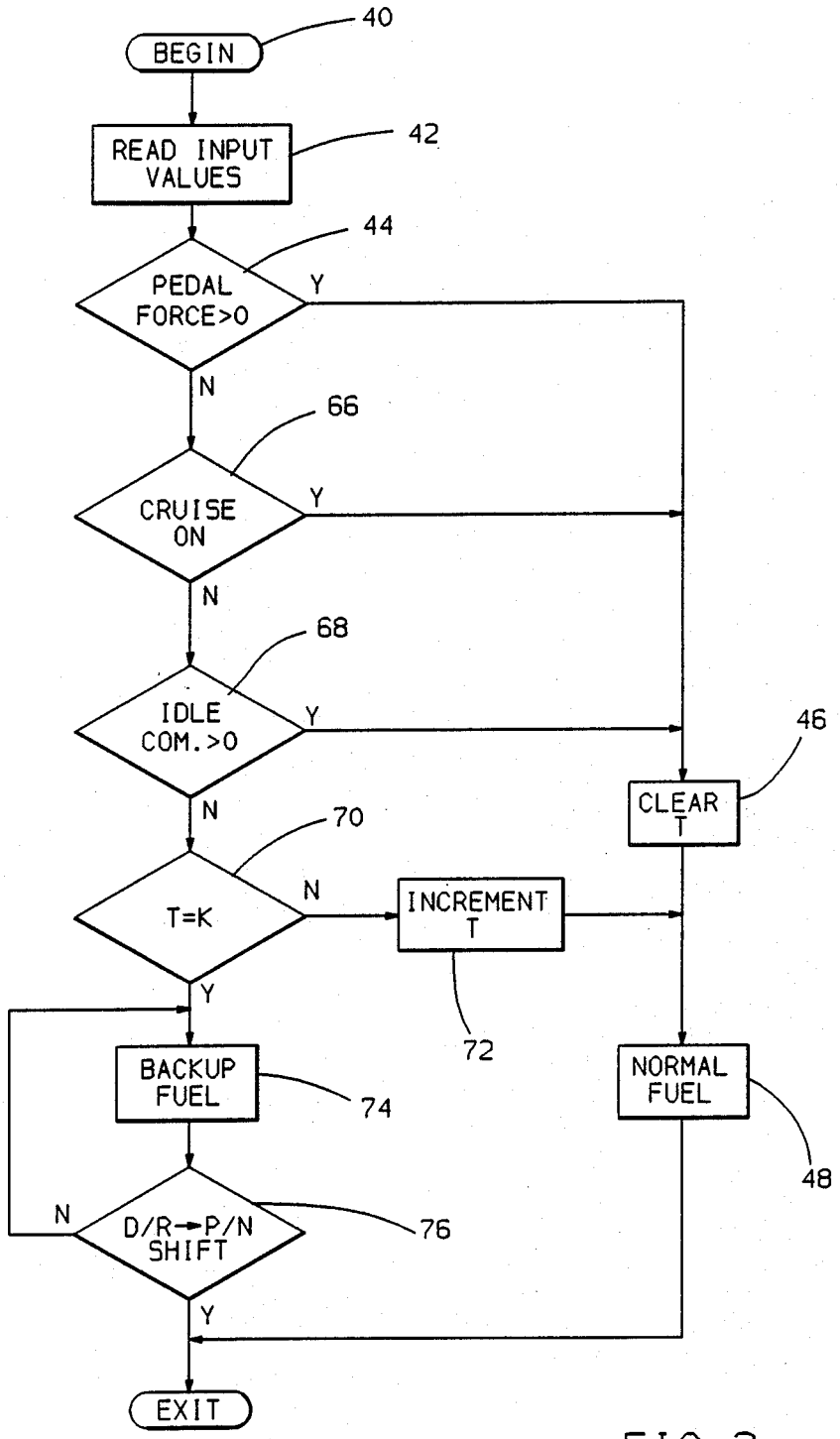
FIGS. 3 and 4 are computer flow diagrams illustrating the operation of the controller of FIG. 2 in carrying out the principles of this invention.
Figure 4:
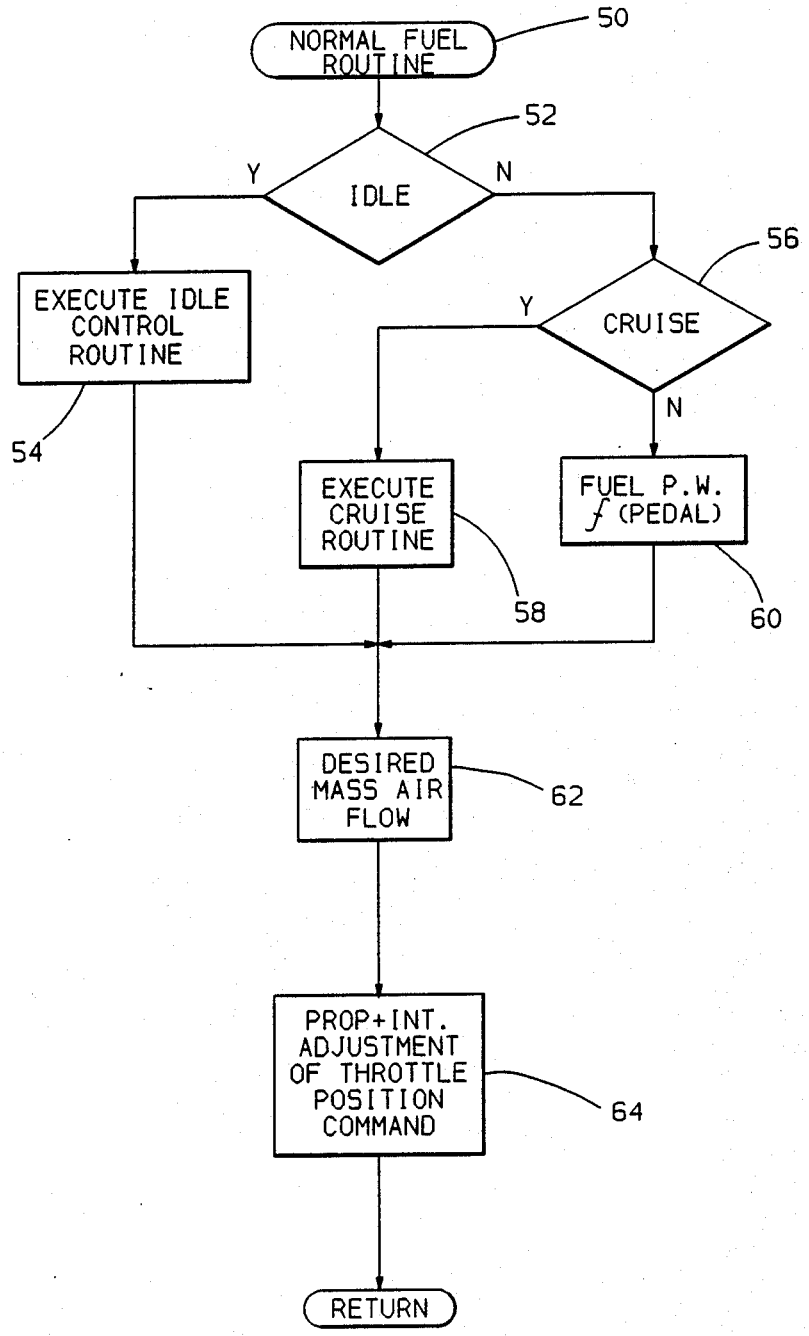

The operation of the engine control computer 28 for controlling the injector 26 and for positioning the throttle blade 24 and for controlling the normal or back-up operating mode in accord with the principles of this invention is illustrated in the FIGS. 3 and 4. The routines illustrated in these Figures are executed at repeated intervals such as 10 millisecond intervals. First referring to FIG. 3, the program begins at step 40 and proceeds to a step 42 where the computer reads and stores the various input values and discrete signal states. Included at this step is the sequential reading and storing of the analog inputs to the analog-to-digital circuit 32 in memory locations in the control computer 28. Thereafter, the program proceeds to a step 44 where the magnitude of the pedal force sensed by the sensor 20 and stored at step 42 is compared to zero. If the force is greater than zero indicating the operator is applying force to the pedal to command a desired off-idle fuel flow, the program proceeds to step 46 where a timer storing a time value T is cleared, the time T representing the duration of a sensed fault condition. Next, a normal fuel control routine is executed at step 48 where the fuel pulse width to be injected with each intake event of the engine 10 is determined and the corresponding throttle position is established. The fuel pulse width is then set into an output counter in the engine control computer 28 and issued with each RPM signal corresponding to each intake event. The desired throttle position is provided to the throttle position servo 38 via the digital-to-analog converter 37.

The normal fuel control routine 48 is more particularly illustrated in FIG. 4. Referring to this Figure, the normal fuel routine is entered at a point 50 and proceeds to a decision block 52 to determine whether or not conditions for establishing an engine idle mode exist. In one embodiment, an idle mode condition may be established when the potentiometer 18 indicates a released position of the accelerator pedal 12. Assuming an idle condition mode exists, the program proceeds to a step 54 where an idle control routine is established. In general, this routine provides for monitoring the speed of the engine 10 and provides for an adjustment of a command fuel pulse width to maintain a desired engine idle speed. This routine may provide for adjustment of the pulse width via proportional and integral control terms as is well known in the control of engine idle speed. This pulse width is set into the output counter in the engine control computer 28 as previously described and issued with each RPM signal for establishing the desired engine idle speed.

Returning to step 52, if the potentiometer 18 indicates an off idle position of the accelerator pedal 12, the program proceeds to a step 56 where the system determines whether or not a cruise control mode has been commanded by the vehicle operator. In general, this mode is commanded by the operator in order to automatically maintain a desired vehicle cruise speed. Assuming the cruise mode has been enabled by the vehicle operator, the program executes a cruise routine 58 that responds to the actual vehicle speed signal and the commanded vehicle speed to adjust the fuel pulse width in direction to achieve the desired vehicle speed. As with the routine 54, the cruise routine may include integral and proportional terms for adjustment of the fuel pulse width to maintain the desired vehicle speed. This pulse is then provided to the output counter in the engine control computer 28 to be issued to the fuel injector 26.

Returning to step 56, if the cruise mode has not been enabled, a step 60 is executed wherein the pulse width to be injected with each intake event of the engine 10 is controlled in accord with the commanded fuel flow represented by the output of the accelerator pedal position sensor 18. This pulse width is set into the output counter in the engine control computer 28 and issued to the fuel injector 26 with each RPM signal.

From either of the routines 54, 58 or 60, the program proceeds to a step 62 where the mass airflow required to produce a desired air/fuel ratio is determined. From this step, the program proceeds to a step 64 where the output to the digital-to-analog converter 37 representing a commanded throttle position is adjusted in accord with the difference between the actual airflow from the mass air sensor measured at step 42 and the desired mass airflow determined at step 48. This signal may be adjusted in accord with proportional and integral terms so as to precisely obtain the desired air/fuel ratio. The throttle position servo 38 responds to this commanded signal to position the throttle blade 24 via the servomotor 30 and the feedback signal from the position sensor 36 to achieve a commanded desired mass airflow into the engine 10. From the step 64, the program returns to the routine of FIG. 3.

Referring again to FIG. 3, if step 44 determines that the pedal 12 is in a released position and no force is being applied thereto by the vehicle operator, the program determines whether or not the system is operating in a mode for which this condition is normal. One such mode is the cruise mode described in regard to FIG. 4.

Operation of this mode is sensed at step 66. If the system is operating in a cruise mode wherein the pedal 12 force is normally zero, the program then proceeds to the step 46 previously described and thereafter to the normal fuel routine 48 which is executed to maintain the desired vehicle speed via the step 58.

If the force applied to the pedal 12 is zero and the system is not in a vehicle cruise mode, the program determines if the remaining operating mode for which this condition is normal exists. As previously indicated, this mode is the idle mode whereat the engine idle speed is controlled via the idle speed control routine 54 of FIG. 4. During this mode, the throttle 24 position is normally established at some value for maintaining a desired engine idle speed. This normal operation is sensed at step 68 which determines whether or not the idle speed command represented by the commanded position of the throttle valve 24 is greater than zero. If greater than zero indicating the idle speed is under control, the program proceeds to the step 46 to clear the timer T to zero after which the normal fuel routine 48 is executed to maintain the desired engine idle speed. However, if a fault condition exists wherein the engine speed is greater than the desired engine idle speed and the idle speed control routine 54 is unable to reduce the engine speed to the desired engine idle speed, the commanded fuel and, therefore, the commanded position of the throttle valve 24 will be reduced until such time that the throttle valve commanded position is set to zero. This fault condition is sensed at step 68 by comparing the commanded throttle position provided to the digital-to-analog converter 37 with zero. If the commanded position is zero indicating the engine idle speed is not under the control of the idle control routine 54, the program proceeds to the step 70 where the duration of T of the fault condition is compared to a calibration constant K, such as 100 milliseconds. If the fault condition has not existed for the time period K, the time value T is incremented at step 72 and the normal fuel routine 48 is executed. However, if the fault condition has existed for the time duration K, the program proceeds to a step 74 where a back-up fuel control routine is executed. During this routine, the fuel pulse width applied to the fuel injector 26 is reduced to some low value to force an engine idle speed condition. The back-up fuel routine 74 may also include the control of the mass airflow as per the step 62 and step 64 previously described in order to maintain a desired air/fuel ratio.

The back-up fuel routine is latched in accord with the preferred embodiment of this invention until such time that the vehicle operator should intentionally shift the vehicle transmission from drive or reverse to park or neutral. This condition is sensed at step 76. Assuming the vehicle operator has not shifted from drive or reverse to park or neutral, the program returns to the back-up fuel routine 74. This cycle is repeated until such time that the vehicle operator shifts the vehicle transmission to park or neutral. When this condition is sensed, the program exits the routine of FIG. 3. This allows the operator to reset the back-up fuel condition. If the fault has been corrected, the normal control of engine fuel and engine air is controlled as previously described. However, if the fault condition continues to exist, the back-up fuel routine 74 will again be enabled as previously described.

In the preferred embodiment of the invention, a fault condition was sensed at step 68 when the commanded throttle position became zero indicating the idle speed control routine not in control of the engine speed. Other parameter may be utilized to sense this fault condition. For example, in one embodiment, the fault condition may be represented by the engine torque output being greater than some predetermined value (which may be a function of temperature). This torque output may be represented by the product of engine speed and the injector pulse width. Alternatively, the fault condition may be represented by a value of engine (which may be a function of engine temperature) that is greater than the engine idle speed at that temperature.

The foregoing description of a preferred embodiment for the purpose of illustrating the invention is not to be considered as limiting or restricting the invention since may modifications may be made by the exercise of skill in the art without departing from the scope of the invention.

I claim:

1. A control system for an internal combustion engine of a vehicle, the engine having an intake space into which air and fuel are supplied, the system comprising in combination:

an accelerator pedal biased to an engine idle position and operable to an engine off-idle position in response to a force applied thereto;

position sensing means for sensing the position of the accelerator pedal established by force applied thereto;

force sensing means for sensing the force applied to the accelerator pedal;

normal fuel control means selectively operable (A) in a first mode for controlling the air and fuel mixture in accord with the accelerator pedal position sensed by the position sensing means and (B) in a second mode for controlling the air and fuel mixture in response to a predetermined operating condition independent of the accelerator pedal position, the force applied to the accelerator pedal being normally zero in the second mode;

means for sensing selected operation of the normal fuel control in the second mode; and means for controlling the air and fuel mixture to a predetermined amount independent of the normal fuel control means in the absence of a sensed selected operation of the normal fuel control in the second mode when the force applied to the accelerator pedal is zero.

2. The control system of claim 1 wherein the second mode is a cruise control mode wherein the air and fuel mixture is controlled to maintain a predetermined speed of the vehicle.

3. A control system for an internal combustion engine of a vehicle, the engine having an intake space into which air and fuel are supplied, the system comprising in combination:

an accelerator pedal biased to an engine idle position and operable to an engine off-idle position in response to a force applied thereto;

position sensing means for sensing the position of the accelerator pedal established by force applied thereto;

force sensing means for sensing the force applied to the accelerator pedal;

normal fuel control means including idle speed control means responsive an idle position of the accelerator pedal and engine speed for adjusting the air and fuel mixture in direction to maintain a predetermined engine idle speed;

means for (A) sensing a predetermined value of the idle speed control means adjustment of the air and fuel mixture in direction tending to reduce engine speed when the sensed force applied to the accelerator pedal is zero, the predetermined value representing the engine speed not being under the control of the idle speed control means and (B) controlling the air and fuel mixture to a predetermined amount independent of the normal fuel control means.

* * * * *